US005470060A

United States Patent [19]

Spiegel

[11] Patent Number: 5,470,060

[45] Date of Patent: Nov. 28, 1995

[54] FOOTBALL WITH ODD NUMBER OF PANELS

[75] Inventor: H. Jay Spiegel, Alexandria, Va.

[73] Assignee: Premium Products, Inc., Alexandria, Va.

[21] Appl. No.: 334,067

[22] Filed: Nov. 4, 1994

[51] Int. Cl.[6] ..... A63B 41/08

[52] U.S. Cl. ..... 273/65 E; 273/65 R; 273/65 EC

[58] Field of Search ..... 273/65 R, 65 E, 273/65 EC, 65 EG, DIG. 20, 65 A, 65 B, 65 F, 65 ED, 58 R, 58 BA

[56] References Cited

U.S. PATENT DOCUMENTS

| | | | |
|---|---|---|---|
| 1,505,802 | 8/1924 | Pierce | 273/65 R |
| 1,518,448 | 12/1924 | Pierce | 273/65 E |
| 3,425,693 | 2/1969 | Murray | 273/65 A |
| 4,462,590 | 7/1984 | Mitchell | 273/65 E |
| 4,531,737 | 7/1985 | Jacobson et al. | 273/65 R |
| 5,098,097 | 3/1992 | Kennedy et al. | 273/65 EC |
| 5,294,112 | 3/1994 | Smith | 273/58 BA |
| 5,342,043 | 8/1994 | Baltronis et al. | 273/65 EC |

FOREIGN PATENT DOCUMENTS

| | | | |
|---|---|---|---|
| 551010 | 3/1922 | France | 273/65 E |
| 266507 | 3/1927 | United Kingdom | 273/65 E |
| 9232 | 6/1988 | United Kingdom | 273/65 ED |

*Primary Examiner*—Vincent Millin
*Assistant Examiner*—Steven B. Wong
*Attorney, Agent, or Firm*—H. Jay Spiegel

[57] ABSTRACT

A football is made in "regulation" size and shape for high school, college and professional football. However, instead of having four panels and four seams as is conventionally the case, an odd number of panels and seams, for example, five panels and seams is provided. When kicking an oblate spheroidal football, the place kicker normally kicks the football at a location diametrically opposite to the location of the laces of the football. By providing an odd number of panels, the disclosed football is preferably kicked at a location where no seam is located thereby enhancing the effectiveness and accuracy of kicking. In one embodiment, the panel opposed to the laces is reinforced with an internal reinforcing panel which internally covers the entire panel. In a second embodiment, two reinforcing patches are provided, each of which is located at a "sweet spot" of the football. In either embodiment, the weight of the reinforcement is equalized to the weight of the laces so that the football remains balanced.

11 Claims, 3 Drawing Sheets

FOOTBALL WITH ODD NUMBER OF PANELS

BACKGROUND OF THE INVENTION

In the game of American football, the football which is employed is known as an oblate spheroidal ball. Those American footballs which are known are constructed of four panels sewn together at four seams, with one of the seams having an opening for insertion of the inflatable bladder, which opening is thereafter closed through the use of laces which are also gripped when the football is thrown.

As is known, the preferred location to kick such a football is diametrically opposite to the seam on which the laces are located. Under such circumstances, with four panels and four seams, this kicking location is located on a seam diametrically opposite to the seam which carries the laces. Thus, the location where the football is commonly kicked is a surface including the described seam as well as the adjacent surfaces of the panels which are interconnected at that seam. Thus, the striking surface of the place kicker's shoe engages a surface of the football which is non-uniform, that is, from left to right, includes a panel surface, a seam and a panel surface. As a football is used and exhibits wear, and under adverse weather conditions such as those including rain and snow, the wear patterns on the surface of a football are non-uniform. In particular, footballs appear to wear more prominently on the panels thereof as compared to within the seams thereof. This inconsistency of wear adds to potential inconsistency in effectiveness of place kicking. Thus, it would be advantageous to place kick a football on a uniform surface thereof to thereby provide uniformity of trajectory and distance.

Unfortunately, as American footballs are now manufactured, in order to kick such a football on a uniform surface such as that which is located on a panel remote from a seam, one would have to rotate the football on its tip to a position where the laces are misaligned from the direction of force application from the foot. Under such circumstances, the resultant weight imbalance caused by this misalignment of the laces will necessarily affect the trajectory of the kicked ball. As such, a need has developed for a football which may be place kicked in an effective manner with the laces aligned with the direction of force application of the place kicker's foot. It is with this need in mind that the present invention was developed.

Applicant is aware of U.S. Pat. No. 4,531,737 to Jacobson et al. Jacobson et al. teach an elongated football which is specifically designed to be easily grasped by the user and which includes three separately inflatable internal bladders. Jacobson et al. teach the use of five panels sewn together with five seams, however, each seam is disclosed as carrying laces or simulated laces. There is no teaching or suggestion by Jacobson et al. that the disclosed "elongated football" is intended to be used in playing the game of American football. Furthermore, clearly, the elongated football of Jacobson et al. may not be effectively place kicked due to its elongated dimensions and the inherent lack of stability which would result. According to the rules of the National Football League, an American football must be 11 to 11½ inches in length, have a long circumference of 28 to 28½ inches and a short circumference of 21 to 21¼ inches and must weigh between 14 and 15 ounces. These dimensions are nowhere contemplated by the Jacobson et al. device.

Applicant is also aware of U.S. Pat. No. 1,505,802 to Pierce which discloses a football having an inflation stem as well as a patch on the other side of the ball designed to balance the weight of the inflation tube. Pierce also contemplates the use of a second filling tube in conjunction with the patch as a balancing means. While Pierce does teach the concept of balancing the weight of the filling tube, Pierce fails to teach balancing the weight of the laces of the football nor the other aspects of the present invention including the use of an odd number of panels and reinforcement of a single panel diametrically opposite to the laces of the ball.

SUMMARY OF THE INVENTION

The present invention relates to embodiments of an improved football with odd number of panels. The present invention includes the following interrelated objects, aspects and features:

(A) In a first aspect, the present invention consists of an oblate spheroidal football generally having the dimensions which are approved for use in American high schools, colleges and in the National Football League. The National Football League requires a football to have a length of 11 to 11½ inches, with a long circumference traversing the tips of the football being 28 to 28½ inches, and with a short circumference midway between the tips of the football and traversing the laces of the football being from 21 to 21¼ inches. Such a football must weigh from 14 to 15 ounces. American high school and college footballs are similarly sized. It is contemplated that the present invention will fall approximately within these required dimensions. As should be understood by those skilled in the art, the principles of the present invention are equally applicable to footballs having dimensions proportional to those described herein, such as, for example, small-sized versions of American footballs as used in "Pee-Wee" leagues and Junior football leagues.

(B) The usual American football is an oblate spheroidal ball having four panels interconnected with four respective interconnecting seams. One of the seams has an opening for insertion of an inflatable bladder, which opening is closed by a series of laces which also serve the purpose of being gripped when the football is thrown.

(C) The present invention improves upon the traditional American football by combining two aspects which together result in enhanced performance of the football when thrown or kicked. Firstly, the football is provided with an odd number of panels which are interconnected with respective seams, odd in number. In the preferred embodiment, as illustrated in the drawing figures, five panels are interconnected together through the use of five respective seams. In this way, the panel which is diametrically opposite to the seam which carries the laces includes a region thereon directly diametrically opposite to the seam carrying the laces which is devoid of a seam. This region includes two "sweet spots" which, when one of them is kicked, provide optimal trajectory and distance of the kicked football. Inconsistencies in kicking which result when the seam opposite the laces in a conventional football is kicked are necessarily eliminated.

(D) In conjunction with the provision of an odd number of panels, the panel, described above, which is to be kicked, which is located diametrically opposite the laces of the ball is reinforced to enhance transfer of force to the football from the place kicker's foot. In one embodiment, this reinforcement consists of an entire reinforcing panel which is affixed to the outer panel on its inner surface, preferably through glueing as well as sewing at the internal portions of the seams. In a second embodiment, two small patch-like reinforcements are affixed to the internal surfaces of the panel at locations surrounding and encompassing the respective "sweet spots" of the football to enhance force transfer at those specific locations. In either embodiment, the reinforcing means is provided with a weight which matches the weight of the laces. In this way, the reinforcing means balances the weight of the laces to provide a football which is better balanced than prior art footballs.

Accordingly, it is a first object of the present invention to provide an improved football with odd number of panels.

It is a further object of the present invention to provide such a football wherein, in the preferred embodiment thereof, five panels are provided.

It is a yet further object of the present invention to provide such a football wherein that panel which is diametrically opposite to the football laces is reinforced through the use of reinforcing means.

It is a still further object of the present invention to provide the reinforcing means as a reinforcement completely covering the internal surfaces of the panel opposite the football laces.

It is a yet further object of the present invention to provide the reinforcing means as two patch-like reinforcements located on the internal surfaces of the panel diametrically opposite to the laces and located at the "sweet spots" of the football.

It is a yet further object of the present invention to provide the reinforcing means of a weight designed to balance the weight of the laces.

These and other objects, aspects and features of the present invention will be better understood from the following detailed description of the preferred embodiments when read in conjunction with the appended drawing figures.

SPECIFIC DESCRIPTION OF THE PREFERRED EMBODIMENTS

Figure 1:
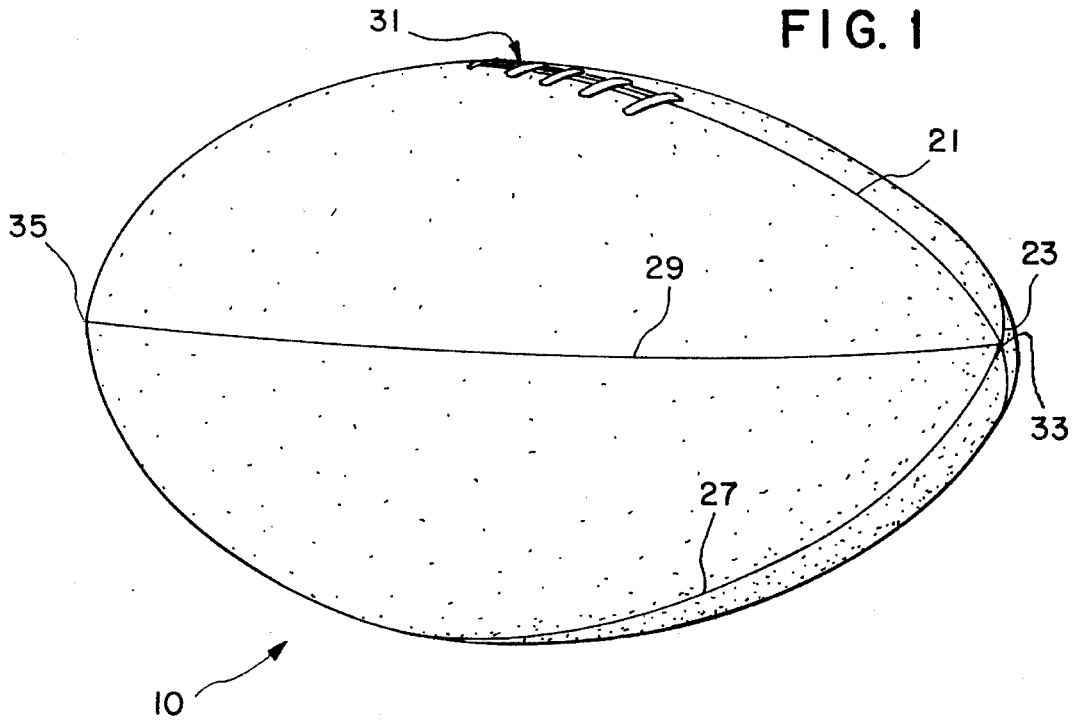
FIG. 1 shows a side perspective view of the present invention.
Figure 2:
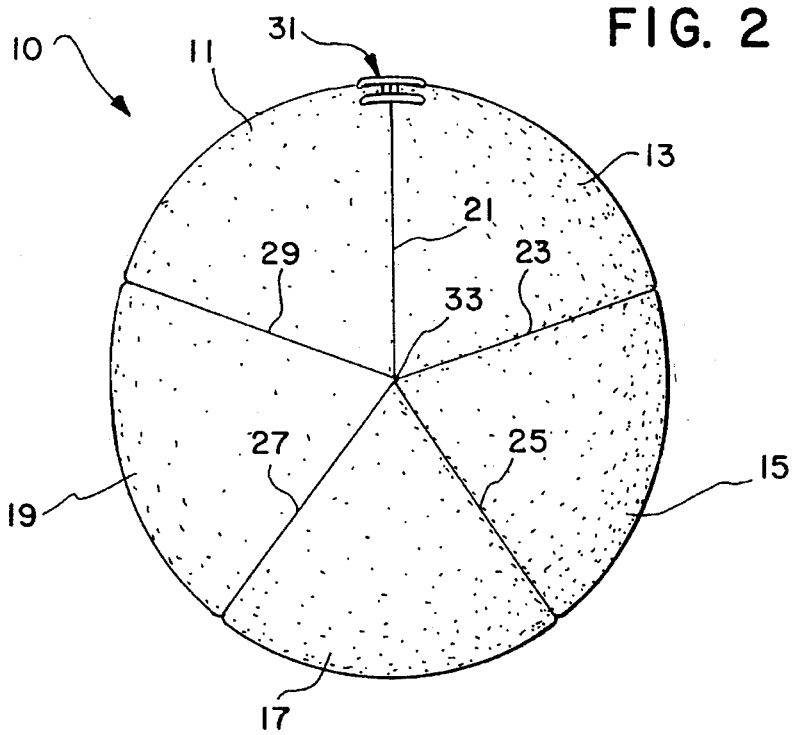
FIG. 2 shows an end view of the present invention.
Figure 3:
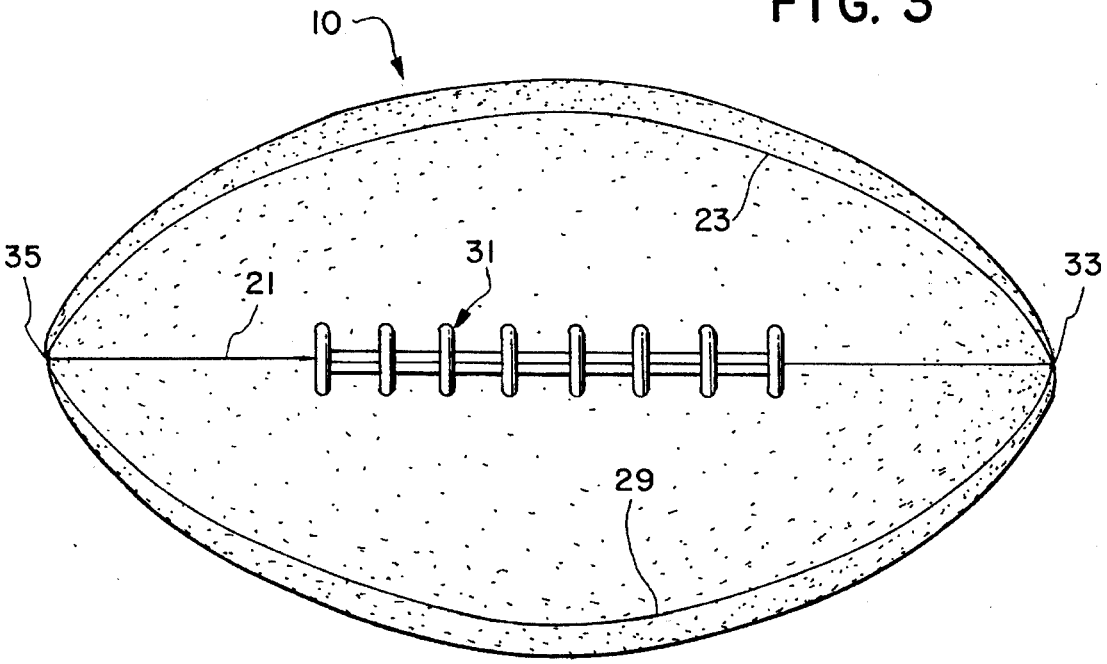
FIG. 3 shows a top view looking down on the laces of the present invention.

With reference, first, to FIGS. 1–3, the inventive football is generally designated by the reference numeral 10 and is seen to include panels 11, 13, 15, 17 and 19.

The panels 11 and 13 are interconnected together at a seam 21. The panels 13 and 15 are interconnected together at a seam 23. The panels 15 and 17 are interconnected together at a seam 25. The panels 17 and 19 are interconnected together at a seam 27. Finally, the panels 19 and 11 are interconnected together at a seam 29. As will be better understood from FIGS. 4 and 5, each of the seams consists of a turned-in portion of each adjacent panel with these turned-in portions abutting one another within the football and being sewn together, as is conventional. As also seen in FIGS. 1, 2 and 3, the seam 21 carries laces 31 which close an opening (not shown) which allows insertion of an inflatable bladder (not shown). The laces 31, the opening (not shown) and the inflatable bladder (not shown) are conventional as is well known by those skilled in the art.

As seen, in particular, in FIGS. 1–3, the respective seams converge at two diametrically opposed ends of the football 10 at the tips 33 and 35.

As seen in the drawings, particularly FIGS. 1–3, the inventive football has five panels interconnected by five seams. As should be understood, the present invention contemplates an American football made having an odd number of panels interconnected by an odd number of respective seams. Thus, within the purview of the present invention, it is contemplated that such a football may be made using five, seven or even nine panels. However, there is an upper limit above which the advantages of the present invention would be overtaken by certain disadvantages. In this regard, each seam consists of a termination of each adjacent panel providing a double thickness which is sewn together to create the seam. As the number of panels increases, the number of locations of this double thickness increases around the circumference of the football and this accordingly increases the weight of the football. Thus, as the number of panels increases, it becomes more difficult to maintain panel thickness while maintaining the football within the weight limitations of the National Football League, college and high school.

Figure 4:
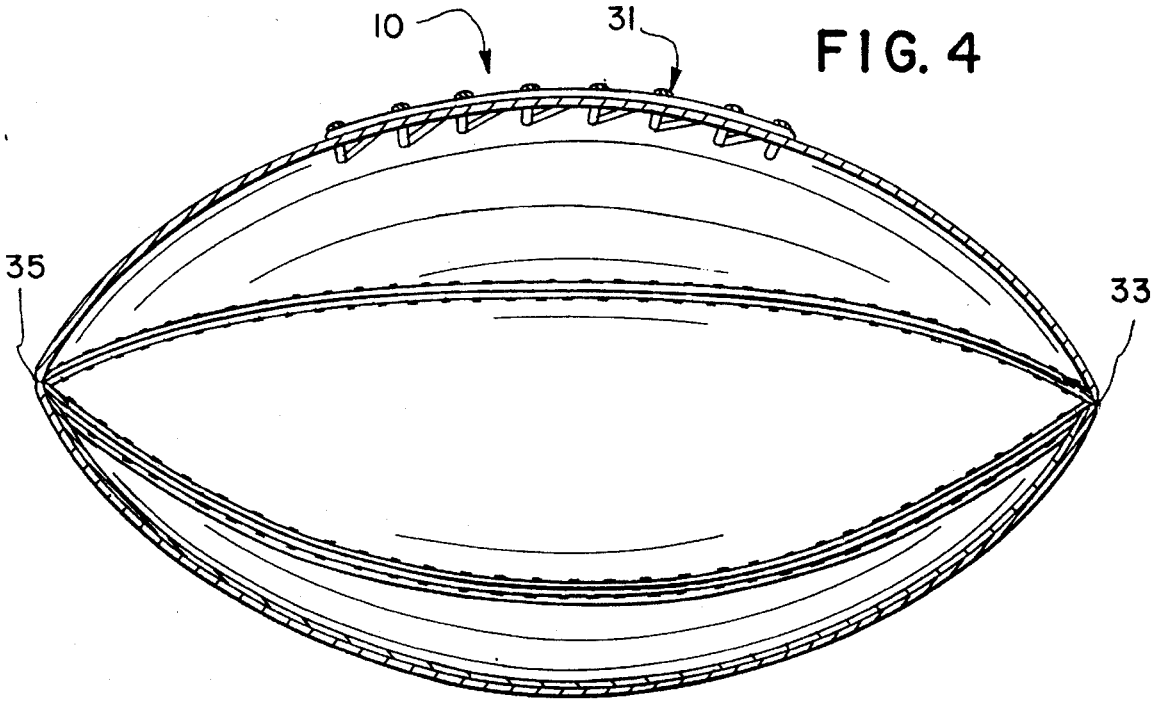
FIG. 4 shows a longitudinal cross-section along the line IV—IV of FIG. 3.
Figure 5:
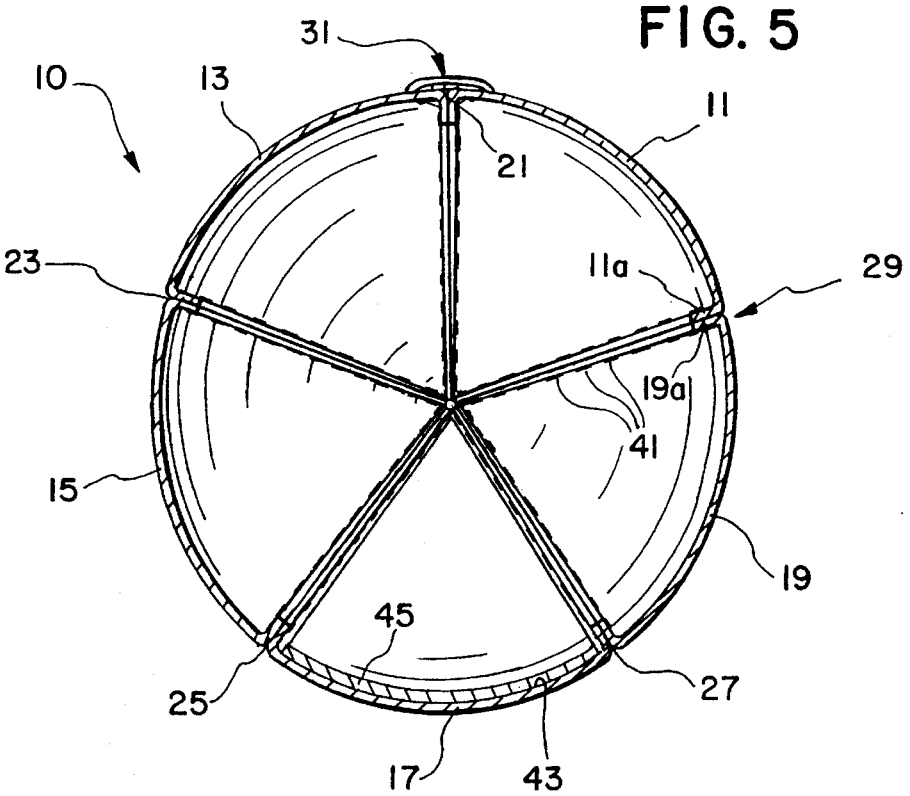
FIG. 5 shows a cross-section along the line V—V of FIG. 3.

With reference to FIGS. 4 and 5, FIG. 5 in particular, the internal structure of the seams is clearly shown. Thus, using the seam 29 for illustrative purposes, it is seen that the panel 11 has an edge 11*a* which is abutted against an edge 19*a* of the panel 19 with these edges being sewn together, with the stitching designated by the reference numeral 41 in FIG. 5.

With further reference to FIG. 5, it is seen that the panel 17 has an internal surface 43 to which is affixed reinforcing means consisting of an additional panel 45 which may be fastened to the inner surface 43 of the panel 17 by any suitable means such as, for example, adhesive. If desired, the periphery of the panel 45 may be sewn to the edges of the panel 17 at the seams 25 and 27. As clearly understood from FIG. 5, the reinforcing panel 45 is diametrically opposite the laces 31 of the football 10. In the preferred embodiment of the present invention, the weight of the panel 45 is selected to be substantially the same as the weight of the laces 31 thereby causing the football 10 to be substantially weight-balanced from one side to the other. While the football 10 is preferably made of a material such as leather, pigskin, rubber or plastic, depending upon the application, the reinforcing panel 45 may be made of any suitable material which provides reinforcement to the panel 17 to best transfer the forces generated by a place kicker's foot through the entire football 10 to cause the football 10 to be effectively propelled through the air. Where the football is made of rubber or plastic, the seams may be simulated to provide the appearance of seams. The panel 45 may be suitably made of plastic, leather, or reinforced materials such as those including carbon fiber, boron fiber, KEVLAR or any other suitable reinforcing materials.

Figure 6:
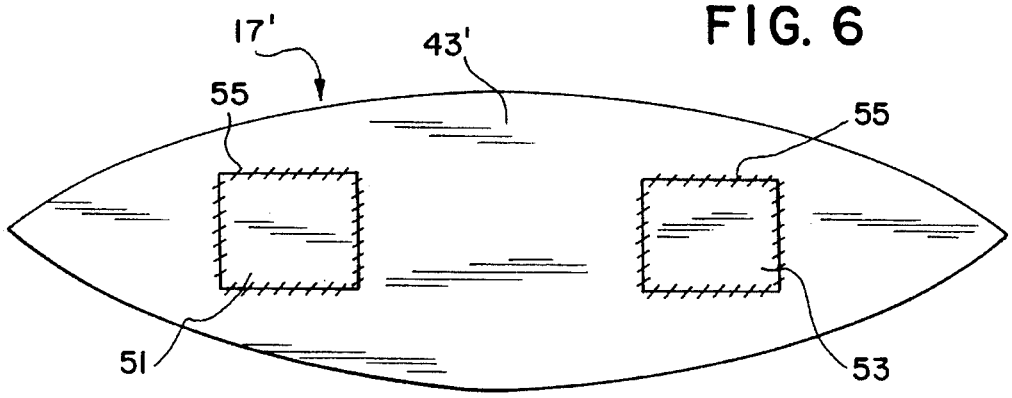
FIG. 6 shows a view of the inside surface of one of the panels of the present invention, in a modification.
Figure 7:
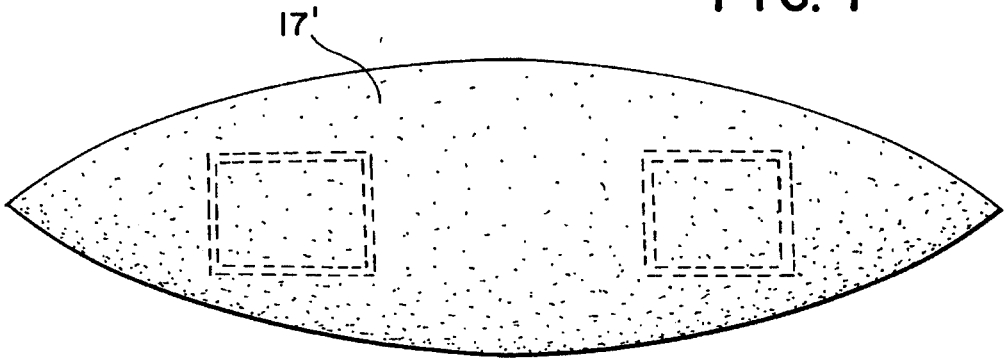
FIG. 7 shows a view of the outer surface of the panel illustrated in FIG. 6.

With reference to FIGS. 6 and 7, a panel 17' is shown which is intended to be located on the football 10 in the same location as the panel 17 as shown in FIGS. 1–5. The panel 17' is, itself, identical to the panel 17. However, instead of employing the reinforcement panel 45, the panel 17' includes two patch-like reinforcing panels 51 and 53 which are best seen in FIG. 6 as attached to the panel 17' through the use of stitching 55. As is known, an oblate spheroidal ball has two "sweet spots", depending upon which tip is facing the ground. When a football such as the football disclosed herein is kicked at one of the "sweet spots", the football will fly through the air with enhanced trajectory, distance and stability. The patch-like reinforcing panels 51, 53 are designed to surround and encompass the "sweet spots" of the football so that when the football is kicked there, maximum transference of force to the entirety of the football will result. Of course, if desired, the panels 51, 53 may be affixed to the internal surface 43' of the panel 17' by any suitable means including through the use of any suitable adhesive. The materials from which the patch-like panels 51, 53 are made may be the same as the materials described hereinabove for the panel 45.

As such, an invention has been disclosed in terms of preferred embodiments thereof which fulfill each and every one of the objects of the invention as set forth hereinabove and provide a new and useful improved football with odd number of panels of great novelty and utility.

Of course, various changes, modifications and alterations in the teachings of the present invention may be contemplated by those skilled in the art without departing from the intended spirit and scope thereof.

As such, it is intended that the present invention only be limited by the terms of the appended claims.

I claim:

1. An oblate spheroidal football, comprising:

a) a body including an odd number of panels connected together;

b) at least one seam interconnecting two adjacent panels and carrying laces;

c) one of said panels having a first external surface diametrically opposite said laces, said first external surface being devoid of a seam, said one of said panels having reinforcing means overlying a second internal surface of said one of said panels aligned with said first surface, said first surface encompassing a "sweet spot" of said football;

d) said football having dimensions of length, long circumference and short circumference of an American football proportional to those commonly used in official games played by American high schools, colleges and professional teams.

2. The football of claim 1, wherein said odd number of panels comprises five panels.

3. The football of claim 2, wherein adjacent said panels are interconnected at respective seams.

4. The football of claim 1, wherein said reinforcing means and said laces are of substantially equal weight.

5. The football of claim 1, wherein said reinforcing means comprises a reinforcing panel substantially covering an entirety of an inner surface of said one of said panels.

6. The football of claim 1, wherein said reinforcing means comprises at least one patch-like panel covering a portion of an inner surface of said one of said panels and surrounding a said "sweet spot".

7. The football of claim 5, wherein said panel is made of leather.

8. The football of claim 5, wherein said panel is made of plastic.

9. The football of claim 6, wherein said panel is made of leather.

10. The football of claim 6, wherein said at least one patch-like panel comprises two patch-like panels each of which is located in encompassing relation to a "sweet spot" of said football.

11. The football of claim 1, having a length of 11 to 11½ inches, a long circumference of 28 to 28½ inches, a short circumference of 21 to 21¼ inches and a weight of 14 to 15 ounces.

* * * * *